US006167592B1

(12) United States Patent
Tsai

(10) Patent No.: US 6,167,592 B1
(45) Date of Patent: Jan. 2, 2001

(54) HANDLE HAVING A COVERING

(76) Inventor: James Tsai, 103, Ta-Ming 1 Rd., Tung Pao Tsun, Tan Tzu Hsiang, Taichung Hsien (TW)

( * ) Notice: Under 35 U.S.C. 154(b), the term of this patent shall be extended for 0 days.

(21) Appl. No.: 09/349,457

(22) Filed: Jul. 8, 1999

(51) Int. Cl.[7] ..... A45C 13/26
(52) U.S. Cl. ..... 16/411; 16/431
(58) Field of Search ..... 16/435, 411, 431

(56) References Cited

U.S. PATENT DOCUMENTS 2,146,415 * 2/1939 Bradley ..... 16/411 X
3,656,594 * 4/1972 Marks et al. ..... 16/411 X
3,692,155 * 9/1972 Laurita ..... 16/411
4,364,150 * 12/1982 Remington ..... 16/411

* cited by examiner

*Primary Examiner*—Robert J. Sandy
(74) *Attorney, Agent, or Firm*—Browdy and Neimark

(57) ABSTRACT

A handle has a body which is formed of two shell members such that the body is provided therein with a receiving space, and in the surface of a grip portion thereof with two slits opposite to each other and extending along the direction of the longitudinal axis of the grip portion. The grip portion is covered by a covering which has two side edges corresponding in direction to the longitudinal axis of the grip portion. The two side edges of the covering are concealed in the receiving space via the slits such that the two side edges form a tubular structure, and that the two side edges are retained in place by a retaining rod located in the receiving space of the body of the handle.

13 Claims, 5 Drawing Sheets

HANDLE HAVING A COVERING

FIELD OF THE INVENTION

The present invention relates generally to a luggage or suitcase handle, and more particularly to an improved handle having a covering.

BACKGROUND OF THE INVENTION

As shown in FIG. 1, a luggage handle 10 of the prior art is provided at a grip portion 13 thereof with a leather covering 11 for enhancing the overall esthetic effect of the luggage. The leather covering 11 of the prior art is defective in design in that the leather covering 11 is attached to the grip portion 13 of the handle 11 by fusing the edges of two opposite ends of the leather covering 11 by sewing, thereby resulting in formation of a ridge 14, which undermines the esthetic effect of not only the luggage on the whole but also the luggage handle 10. In addition, the ridge 14 causes a great deal of inconvenience to a hand holding the handle 10.

SUMMARY OF THE INVENTION

The primary objective of the present invention is therefore to provide a handle with a covering which is free from the shortcomings of the prior art covering described above.

In keeping with the principle of the present invention, the foregoing objective of the present invention is attained by a covering which is attached to the outer surface of the grip portion of a handle such that two side edges of two opposite ends of the covering is concealed in the interior of the handle. The ridge is held securely in the interior of the handle by a retaining rod.

The foregoing objective, features, functions, and advantages of the present invention will be more readily understood upon a thoughtful deliberation of the following detailed description of two preferred embodiments of the present invention with reference to the accompanying drawings.

DETAILED DESCRIPTION OF THE INVENTION

Figure 1:
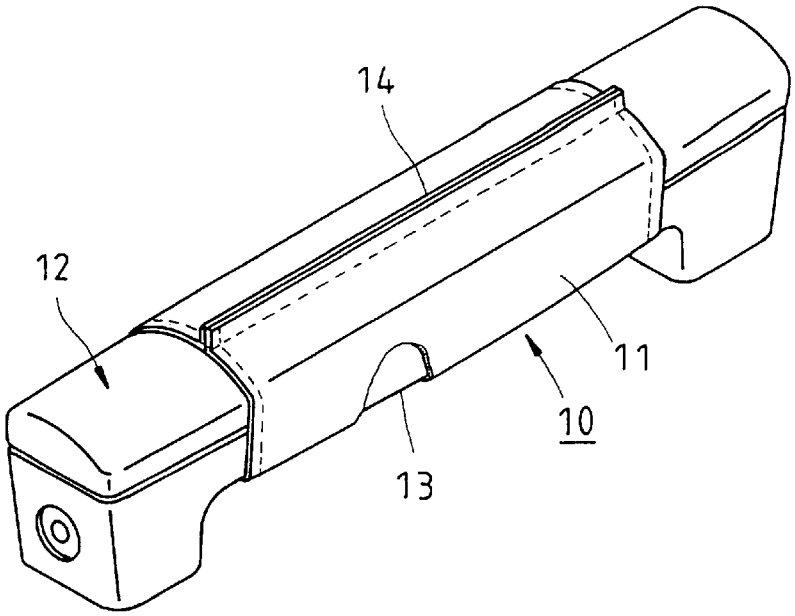
FIG. 1 PRIOR ART
FIG. 1 shows a perspective view of a prior art handle having a covering.
Figure 3:
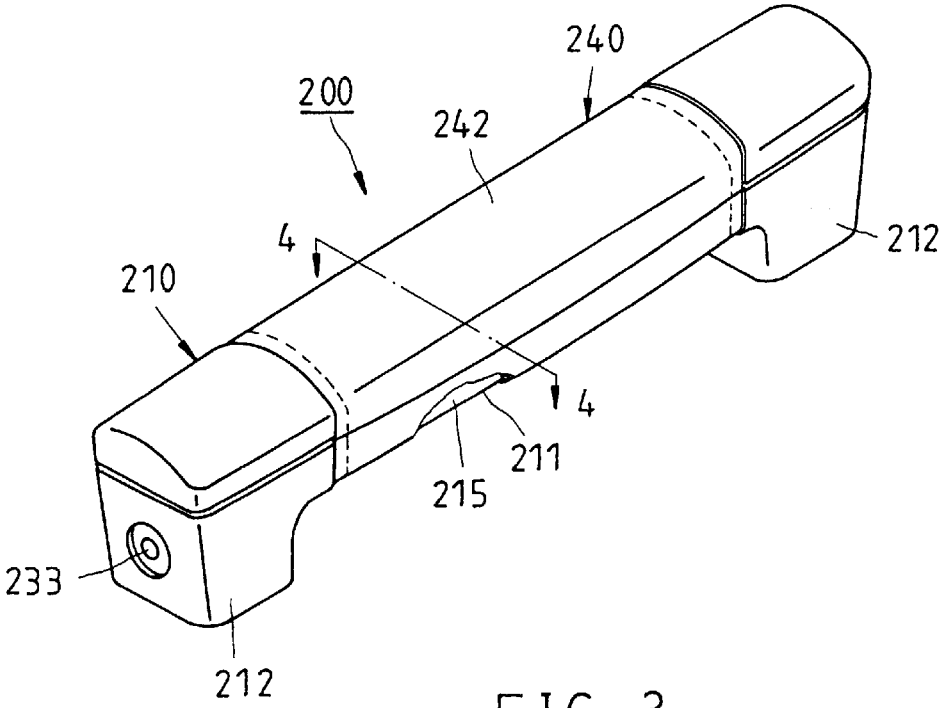
FIG. 3 shows a perspective view of the first preferred embodiment of the present invention in combination.
Figure 2:
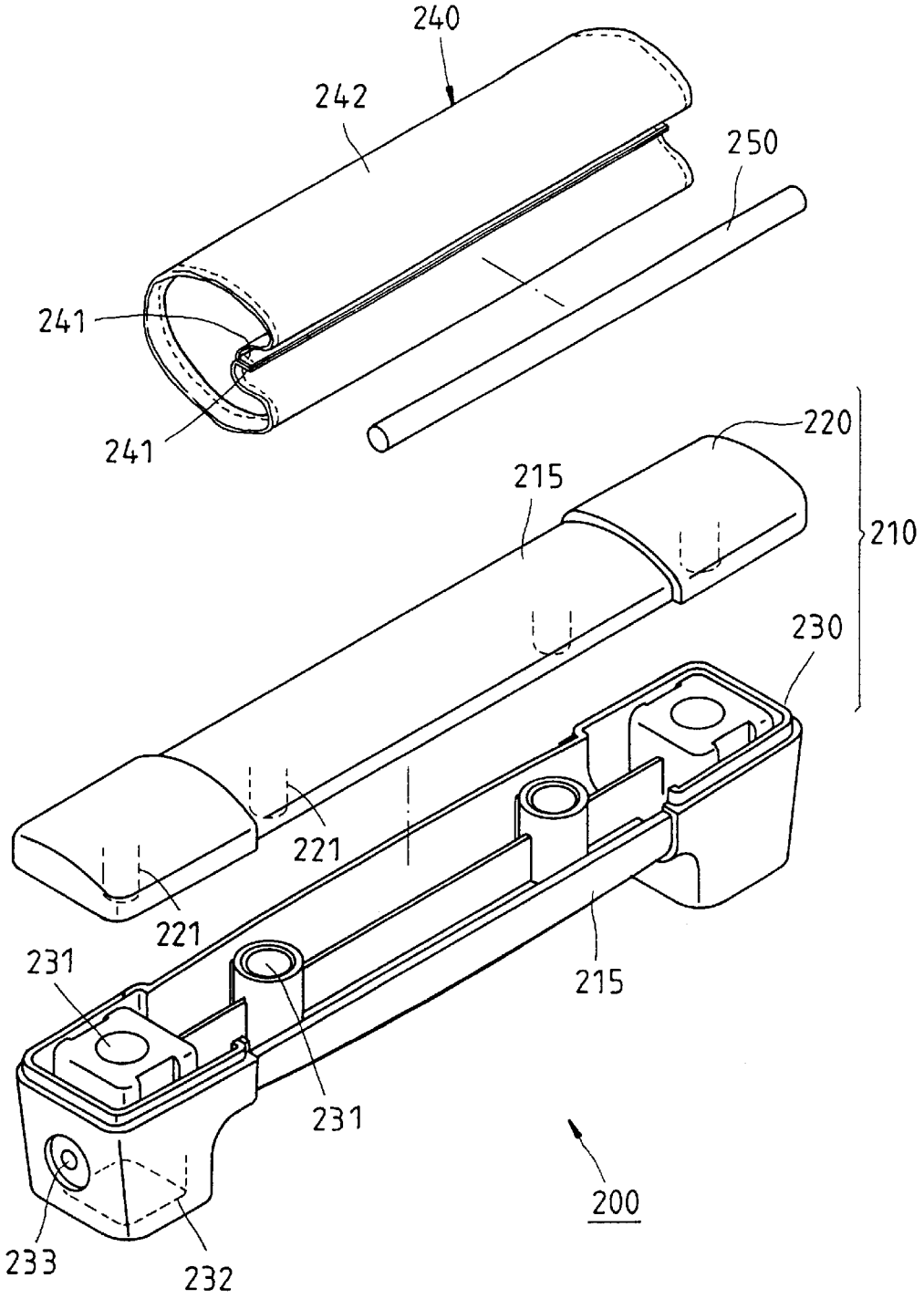
FIG. 2 shows an exploded view of a first preferred embodiment of the present invention.
Figure 4:
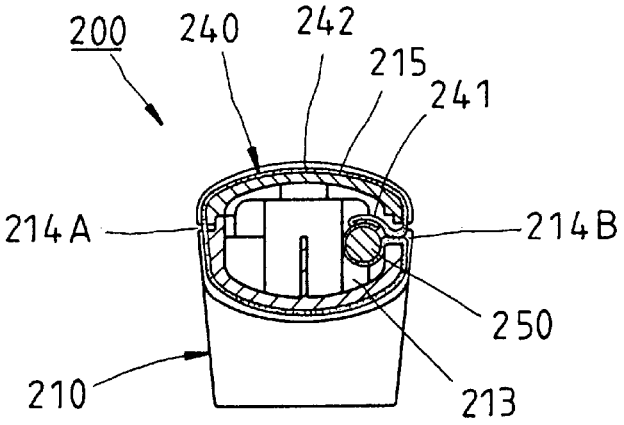
FIG. 4 shows a sectional view of a portion taken along the direction indicated by a line 4—4 as shown in FIG. 3.
Figure 5:
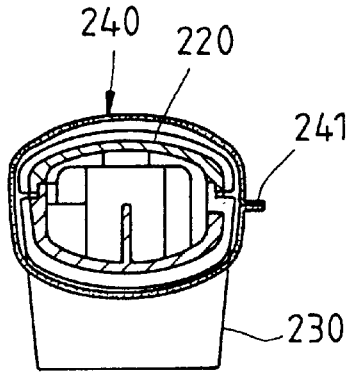
FIG. 5 is a sectional view showing that the covering of the present invention is fitted over the handle.

As shown in FIGS. 2–4, a handle 200 of the first preferred embodiment of the present invention has a body 210, a covering 240, and a retaining rod 250 located in the interior of the body 210.

The body 210 is formed of a first shell member 220 and a second shell member 230, which are respectively made integrally of a plastic material by injection molding. The first shell member 220 is provided with four locating pillars 221, whereas the second shell member 230 is provided with four locating slots 231 corresponding in location to the four locating pillars 221. The first shell member 220 and the second shell member 230 are joined together to form the body 210 such that the four locating pillars 221 of the first shell member 220 are retained in the four locating slots 231 of the second shell member 230. Now referring to FIG. 3, the body 210 of the present invention is shown to have a grip portion 211 which is located in the middle of the body 210 to facilitate the gripping of the handle 200. The body 210 is provided at both ends of the longitudinal axis thereof with a connection portion 212 by which the body 210 is connected directly or indirectly with a suit case or luggage. The two connection portions 212 of the body 210 of the first preferred embodiment of the present invention are connected with a handle of a luggage having an expandable pull rod. The connection portions 212 are provided in the underside thereof with an insertion hole 232 in communication with the locating slot 231 which is located at the end of the second shell member 230. The first shell member 220 and the second shell member 230 are fastened together by two screws (not shown in the drawings) which are respectively fastened onto the locating pillar 221 via the insertion hole 232 and the locating hole 231. The connection portions 212 are further provided with a through hole 233 for fastening the pull rod by a screw which is fastened onto the pull rod via the through hole 233. As shown in FIG. 4, the grip portion 211 of the body 210 is provided therein with a receiving space 213 and is further provided in two sides thereof with a combination slit 214A (214B) extending along the direction of a longitudinal axis thereof. The combination slit 214A is completely sealed off, whereas the combination slit 214B has an interstice having a width which is twice the thickness of the covering 240. The grip portion 211 has a peripheral surface which is slightly depressed than the connection portions 212, thereby forming a shallow slot 215 which has a depth equal to the thickness of the covering 240.

The covering 240 is made of a genuine leather or a synthetic leather and is rectangular in shape when spread out. Preferably, the quality of the covering 240 matches the quality of the material of which the luggage is made. The covering 240 may be also made of a fabric material. The grip portion 211 of the body 210 of the handle 200 is embraced by the covering 240 whose side edges 241 of the longitudinal ends thereof are fused together by sewing or adhesive. These two side edges 241 are corresponding in direction to the longitudinal axis of the grip portion 211 and are equal in length to the grip portion 211. In addition to the two side edges 241, the covering 240 has other two side edges which are longer than the peripheral length of the grip portion 211. As shown in FIG. 4, the fused edges 241 of the covering 240 are received in the receiving space 213 via the combination slit 214B of the grip portion 211. The combination slit 214B is provided with an interstice which has an appropriate width so as to prevent it from hindering the combination of the two shell members 220 and 230. The fused edges 241 of the covering 240 are received in the receiving space 213 such that the fused edges 241 are tubular in shape. The covering 240 has a main portion 242, which embraces the grip portion 211 in such a manner that the main portion 242 comes in close contact with the shallow slot 215 of the grip portion 211.

The retaining rod 250 is made of a plastic material and is round in its cross section. The retaining rod 250 is equal in length to the grip portion 211 of the body 210 and is disposed in the receiving space 213 such that the retaining rod 250 is embraced by the side edges 241, as shown in FIG. 4. The retaining rod 250 has a predetermined roughness to enhance the holding of the side edges 241 of the covering 240.

Figure 6:
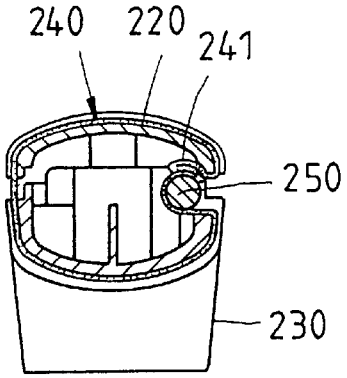
FIG. 6 is a sectional view showing that the ridge of the covering and the retaining rod of the present invention are disposed in the interior of the handle.

In combination, the side edges 241 of the covering 240 are first formed by sewing, thereby forming a tubular covering 240 which is then fitted over the grip portion 211 of the body 210 whose first shell member 220 and the second shell member 230 are not yet fastened together. In light of the covering 240 being much greater in peripheral length than the body 210, the covering 240 can be easily fitted over the grip portion 211 of the body 210. Now referring to FIG. 6, the first shell member 220 and the second shell member 230 are separated so as to locate the side edges 241 of the covering 240 at one side of the combination slit 214B which has an interstice. The side edges 241 are then pressed inwardly by the retaining rod 250 while the first shell member 220 and the second shell member 230 are joined together, thereby causing the retaining rod 250 and the side edges 241 of the covering 240 to be forced into the receiving space 213 of the body 210. Finally, the two shell members 220 and 230 are fastened securely by two screws. It is therefore readily apparent that the covering 240 is fitted over the grip portion 211 of the handle 200 with ease and speed. Unlike the prior art technique, the work of sewing the side edges 241 of the covering 240 of the present invention is done before the covering 240 is fitted over the grip portion 211 of the handle 200. In addition, the side edges 241 of the covering 240 are concealed in the body 210 of the handle 200.

It must be noted here that the body of the handle of the present invention may be formed by the first shell member and the second shell member, which are joined together leftward and rightward. As a result, the combination slits of the grip portion are located in the upper side and the lower side. As a result, the side edges of the covering can be forced into the body of the handle from the lower side.

Figure 7:
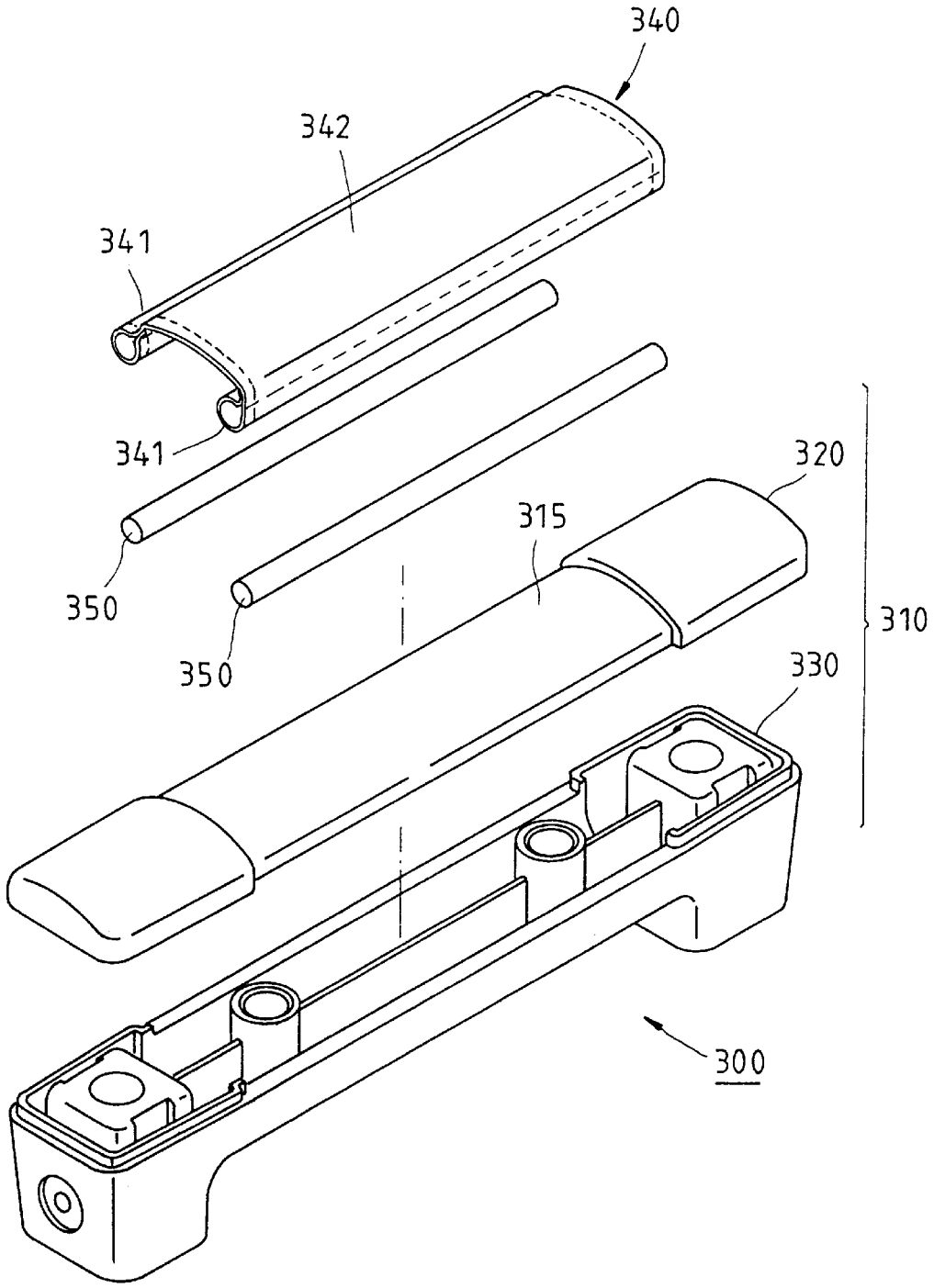
FIG. 7 shows an exploded view of a second preferred embodiment of the present invention.
Figure 8:
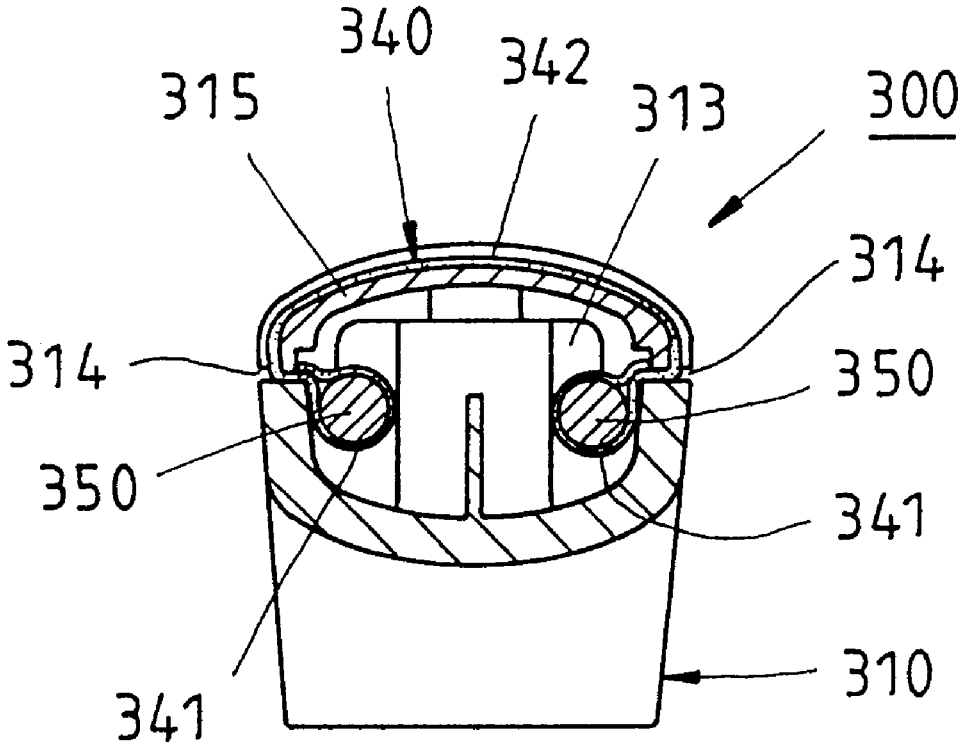
FIG. 8 shows a cross-sectional view of the second preferred embodiment of the present invention in combination.

As shown in FIGS. 7 and 8, the present invention described above may be modified in such a way that the grip portion of the handle is partially covered with the covering. A handle 300 of the second preferred embodiment of the present invention comprises a body 310, a covering 340 which covers only the upper side of the body 310, and two retaining rods 350 which are disposed in two opposite sides of the interior of the body 310.

The body 310 is similar in construction to the body 210 of the first preferred embodiment of the present invention and is formed of a first shell member 320 and a second shell member 330. The differences between the first and the second preferred embodiments are that two combination slits 314 of the grip portion 311 of the second preferred embodiment are provided with an interstice which has a width equal to a thickness of the covering 340, and that only the first shell member 320 is provided with a shallow slot 315 which is intended to accommodate the covering 340. As shown in FIG. 7, the covering 340 has two longitudinal sides which are corresponding in direction to the longitudinal axis of the grip portion 311 and are equal in length to the grip portion 311. Two tubular side portions 341 are formed by the two longitudinal sides of the covering 340 by sewing, as shown in FIG. 7. Now referring to FIG. 8, the two tubular side portions 341 of the covering 340 are disposed in the receiving space 313 via the two combination slits 314 each having an interstice. The covering 340 has a main portion 342, which comes in close contact with the shallow slot 315 of the first shell member 320.

The two retaining rods 350 are respectively received in the two tubular side portions 341 of the covering 340. The two retaining rods 350 have a predetermined roughness and are securely held along with the tubular side portions 341 of the covering 340 by the two shell members 320 and 330. As a result, the main portion 342 of the covering 340 is held securely in place on the surface of the grip portion 311 of the handle 300.

What is claimed is:

1. A handle comprising a body having a grip portion, and a covering which covers said grip portion whereby said grip portion is provided at both longitudinal ends thereof with a connection portion; wherein said body is formed of a first shell member and a second shell member; wherein said grip portion is provided therein with a receiving space extending along the direction of a longitudinal axis thereof and is further provided in an outer surface thereof with two combination slits opposite in location to each other and extending along the direction of the longitudinal axis thereof whereby at least one of said two combination slits is provided with an interstice of a width; wherein said covering has two side edges corresponding in direction to a longitudinal axis of said grip portion whereby said two side edges are received in said receiving space of said grip portion via said one of said two combination slits such that said two side edges embrace a retaining rod having a predetermined roughness to prevent said two side edges from slipping out of said receiving space.

2. The handle as defined in claim 1, wherein said covering embraces said grip portion such that said two side edges of said covering are received in said receiving space via said one combination slit whereby said two side edges join together to be of a tubular construction; and wherein said one combination slit has a width equal to two times the thickness of said covering.

3. The handle as defined in claim 2, wherein said first shell member and said second shell member of said body are superimposed.

4. The handle as defined in claim 2, wherein said first shell member and said second shell member of said body are joined together side by side.

5. The handle as defined in claim 2, wherein said covering is made of a leather; and wherein said two side edges of said covering are joined together by sewing.

6. The handle as defined in claim 2, wherein said grip portion of said body is provided with a shallow slot having a depth equal to a thickness of said covering; and wherein said covering covers said grip portion in such a manner that said covering comes in close contact with said shallow slot.

7. The handle as defined in claim 1, wherein each of said two combination slits has an interstice of a width equal to the thickness of said covering; and wherein said two side edges of said covering are received in said receiving space via said two combination slits such that each of said two side edges is tubular in construction.

8. The handle as defined in claim 7, wherein said covering coves only said grip portion of said first shell member.

9. The handle as defined in claim 8, wherein said first shell member and said second shell member of said body are joined together side by side.

10. The handle as defined in claim 7, wherein said covering covers only said grip portion of said second shell member.

11. The handle as defined in claim 10, wherein said first shell member and said second shell member of said body are joined together side by side.

12. The handle as defined in claim 7, wherein said covering is made of a leather; and wherein said two side edges of said covering are joined together by sewing.

13. The handle as defined in claim 7, wherein said grip portion of said body is provided with a shallow slot having a depth equal to a thickness of said covering; and wherein said covering covers said grip portion in such a manner that said covering comes in close contact with said shallow slot.

* * * * *